US011352826B1

(12) United States Patent
Cui

(10) Patent No.: US 11,352,826 B1
(45) Date of Patent: Jun. 7, 2022

(54) INTELLIGENT DOOR CONTROL SYSTEM AND METHOD

(71) Applicant: SHANGHAI IMILAB TECHNOLOGY CO., LTD., Shanghai (CN)

(72) Inventor: Wei Cui, Shanghai (CN)

(73) Assignee: SHANGHAI IMILAB TECHNOLOGY CO., LTD., Shanghai (CN)

( * ) Notice: Subject to any disclaimer, the term of this patent is extended or adjusted under 35 U.S.C. 154(b) by 0 days.

(21) Appl. No.: 17/371,062

(22) Filed: Jul. 8, 2021

(30) Foreign Application Priority Data

Apr. 27, 2021 (CN) ..... 202110457110.0
Apr. 27, 2021 (CN) ..... 202120879647.1
Apr. 27, 2021 (CN) ..... 202120882352.X

(51) Int. Cl.

| | |
|---|---|
| ***G08B 13/00*** | (2006.01) |
| ***E05F 15/72*** | (2015.01) |
| ***E05F 15/71*** | (2015.01) |
| ***E05F 15/73*** | (2015.01) |
| ***E05F 15/77*** | (2015.01) |

(52) U.S. Cl.
CPC ..... *E05F 15/72* (2015.01); *E05F 15/71* (2015.01); *E05F 15/73* (2015.01); *E05F 15/77* (2015.01); *E05F 2015/763* (2015.01); *E05F 2015/767* (2015.01); *E05Y 2201/422* (2013.01); *E05Y 2400/816* (2013.01); *E05Y 2400/818* (2013.01)

(58) Field of Classification Search
CPC .. G05B 2219/2642; E05F 15/73; E05F 15/70; F24F 11/80; F24F 2110/12; G05D 22/02; G08B 13/00; G08B 25/008; G08B 29/185; H05K 5/0213; H05K 7/20745; H05K 7/20754; H05K 7/20836
See application file for complete search history.

(56) References Cited

U.S. PATENT DOCUMENTS

| | | | | |
|---|---|---|---|---|
| 2006/0179853 | A1* | 8/2006 | Vosburgh | B60H 3/0085 62/126 |
| 2021/0201636 | A1* | 7/2021 | Amir | G08B 25/008 |
| 2021/0219462 | A1* | 7/2021 | Bailey | H05K 7/20745 |
| 2021/0246705 | A1* | 8/2021 | Kato | B60J 5/0487 |
| 2021/0262275 | A1* | 8/2021 | Demele | E05F 15/652 |

* cited by examiner

*Primary Examiner* — Dionne Pendleton
(74) *Attorney, Agent, or Firm* — Fideli Law PLLC

(57) ABSTRACT

An intelligent door control system and method is provided. The intelligent door control method includes the following steps: receiving an ambient temperature inside and outside a door body of the intelligent door through a first sensor and a second sensor which are respectively installed inside and outside the door body of the intelligent door; comparing the ambient temperature inside the door with a preset first temperature threshold, and comparing the ambient temperature outside the door with a preset second temperature threshold; automatically controlling the intelligent door according to whether there is a living body inside the intelligent door, and comparison results of the ambient temperatures inside and outside the door body with the first and second temperature thresholds respectively.

23 Claims, 5 Drawing Sheets

INTELLIGENT DOOR CONTROL SYSTEM AND METHOD

RELATED APPLICATIONS

This application claims priority to Chinese Application number 202120882352.X, filed on Apr. 27, 2021, Chinese Application number 202110457110.0, filed on Apr. 27, 2021, Chinese Application number 202120879647.1, filed on Apr. 27, 2021, which are incorporated herein by reference.

TECHNICAL FIELD

The present disclosure relates to the field of intelligent homes, in particular to an intelligent door control system and method.

BACKGROUND

At present, most doors on the market are non-intelligent doors, that is, they are mechanical systems alone, which is not capable of being opened automatically when a fire occurs indoors. The position of the door handle of a traditional mechanical door is relatively high. When a fire occurs indoors, elderly or disabled people may not be able to open the door. In addition, children may also have difficulties to open such a door due to the high position of the door handle. Moreover, when a fire occurs, people at the site may be panic and do not what to do. Thus, people may take some time or need a reminder to open the door. Sometimes, when a fire occurs, the door handle may be too hot to be touched by hand; or smoke may prevent people from easily finding the door handle. Thus, the door may not be opened in time to allow people to escape from indoors, and rescuers to get in.

There are some intelligent door locks with temperature sensors on the market, when the temperature sensors detect that the ambient temperature reaches a set value, the door locks will open automatically. These intelligent door locks with temperature sensors may be provided on traditional mechanical doors to solve the aforementioned problems. However, they may introduce new security risks. For example, if someone heats the temperature sensor from outside, the door may be opened automatically, which may cause personal and/or property loss. In addition, if a fire occurs outside, when the temperature sensor detects the high temperature, it may open the door and let the fire enter the room.

Therefore, there is a need for an intelligent door control system and method.

SUMMARY

In view of the above-mentioned shortcomings, the technical problem to be solved by some exemplary embodiments of this disclosure is to open the door automatically when a fire occurs to allow people to escape.

According to one aspect of the present disclosure, an intelligent door control system used is provided, including: a first sensor arranged on a door body of an intelligent door to sense an indoor parameter of ambient environment at an indoor side of the door body; a second sensor arranged on an outdoor side of the intelligent door to sense an outdoor parameter of ambient environment at outdoor side of the door body; a controller in communication with the first sensor and the second sensor to: receive the indoor parameter and the outdoor parameter, compare the indoor parameter with a corresponding indoor parameter threshold to obtain a first result, compare the outdoor parameter with a corresponding outdoor parameter threshold to obtain a second result, and automatically control the intelligent door based on the first result, the second result, and whether there is a living body at the indoor side of the intelligent door.

According to another aspect of the present disclosure, an intelligent door control method is provided, including: receiving, by a controller, an indoor parameter of ambient environment at an indoor side of a door body from a first sensor and an outdoor parameter of ambient environment at an outdoor side of the door body from a second sensor; comparing the indoor parameter with a corresponding indoor parameter threshold to obtain a first result; and comparing the outdoor parameter with a corresponding outdoor parameter threshold to obtain a second result; and controlling, by the controller, the intelligent door based on the first result, the second result, and whether there is a living body at the indoor side of the intelligent door.

In addition, the above summary does not enumerate all the essential features of the present disclosure. In addition, sub-combinations of these feature groups may also constitute inventions.

BRIEF DESCRIPTION OF THE DRAWINGS

In order to explain the technical solutions in the disclosure, the following will briefly describe the drawings needed in the embodiment description. Obviously, the drawings in the following description are only some exemplary embodiments of the disclosure. For those skilled in the art, other drawings may be obtained according to these drawings without creative efforts.

DETAILED DESCRIPTION

The following description provides the specific disclosure scenarios and requirements of this disclosure in order to enable those skilled in the art to make or use the contents of this disclosure. Various modifications to the disclosed embodiments will be apparent to those skilled in the art, and the general principles defined herein may be applied to other embodiments without departing from the scope of this disclosure. Therefore, this disclosure is not limited to the illustrated exemplary embodiments, but is in accordance with the broadest scope consistent with the claims.

In this disclosure, the term "outside" (outdoor) refers to the outside of an enclosed space formed by a closed door mounted to a wall; the term "inside" (indoor) refers to the inside of an enclosed space formed by a closed door mounted to a wall. That is to say, the expression of inside a door (indoors) herein refers to on an indoor side of a door or inside a space defined by the door and walls connected thereto; and the expression of outside a door (outdoors) refers to on an outdoor side of the door or outside a space defined by the door and walls connected thereto.

The existing doors may have the following problems: (1) the traditional mechanical doors are not able to open automatically when a fire occurs, this may prevent people from escaping from the site, and rescuers from accessing the site; (2) a traditional door with a temperature sensor may cause safety risks, for example, the door may be easily opened from outside by heating the sensor; (3) When a fire occurs, a traditional door may be easily closed by accident.

In view of the above problems, the present disclosure provides an intelligent door control system and a control method, which may determine whether a fire occurs inside or outside a door body through sensors respectively installed on an inner side and an outer side of the door body of the intelligent door, and then automatically open the door when a fire occurs, so as to inform and facilitate people to escape.

Figure 1:
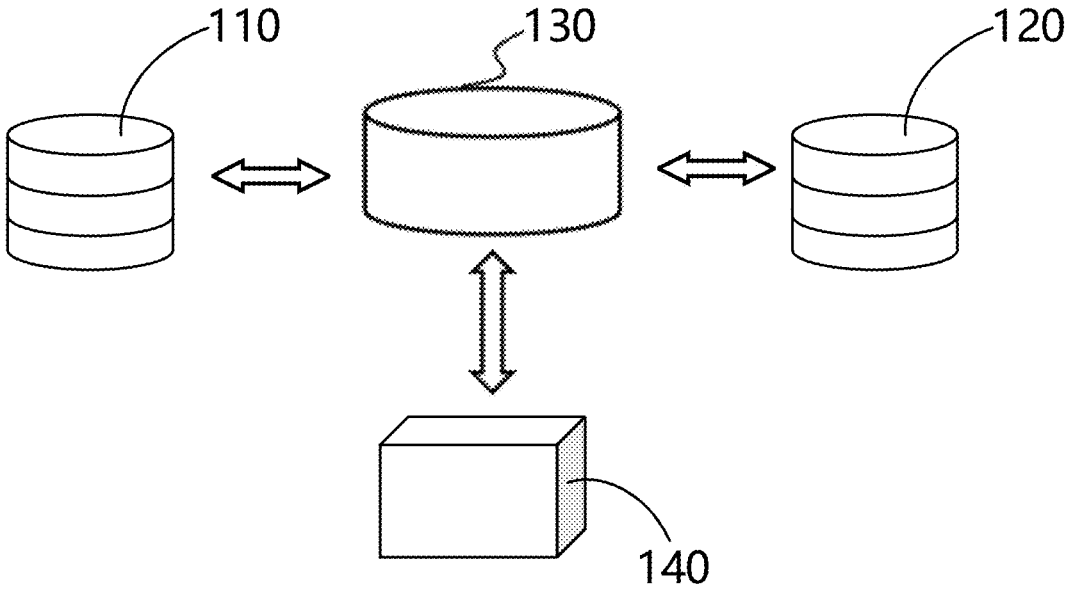
FIG. 1 is a schematic diagram of an intelligent door control system according to some exemplary embodiments of the present disclosure.

FIG. 1 is a schematic diagram of an intelligent door control system according to some exemplary embodiments of the present disclosure.

As shown in FIG. 1, the intelligent door control system for automatically controlling an intelligent door when the temperature inside the intelligent door (i.e., the indoor side temperature of the intelligent door) and/or outside the intelligent door (i.e., the outdoor side temperature of the intelligent door) is abnormal is provided, including: a first sensor 110 installed a door body of the intelligent door for sensing an ambient temperature and/or smoke concentration inside the door body; a second sensor 120 installed outside the door body of the intelligent door for sensing an ambient temperature and/or smoke concentration outside the door body (it is noted that the "inside" and "outside" herein are in accordance with the definitions provided in the second paragraphs in the section of Detailed Description, i.e., the expression of inside a door herein refers to an indoor side of a door, and the expression of outside a door refers to on an outdoor side of the door); a controller 130 in communication with the first sensor 110 and the second sensor 120 at the same time. The controller 130 may perform the following steps: receiving the ambient temperature and/or smoke concentration inside the door body sent by the first sensor 110, and receiving the ambient temperature and/or smoke concentration outside the door body sent by the second sensor 120; comparing the ambient temperature inside the door with a preset first temperature threshold and/or comparing the smoke concentration inside the door with a preset first smoke concentration threshold, and comparing the ambient temperature outside the door with a preset second temperature threshold and/or comparing the smoke concentration outside the door with a preset second smoke concentration threshold; and automatically controlling the intelligent door 140 according to whether there is a living body inside the intelligent door, and the comparison results of the ambient temperatures inside and outside the door body with the first and second temperature thresholds respectively and/or the comparison results of the smoke concentrations inside and outside the door body with the first and second smoke concentration thresholds respectively.

As shown in FIG. 1, the intelligent door control system may includes a first sensor 110 and a second sensor 220. The first sensor 110 may be installed inside the intelligent door for sensing the ambient temperature and/or smoke concentration inside the door. The second sensor 120 may be installed on the outside of the intelligent door for sensing the ambient temperature and/or smoke concentration outside the door. The first sensor 110 and the second sensor 120 may send the sensed ambient temperature and/or smoke concentration to the controller 130.

An existing traditional mechanical door is typically not capable of determining whether there is a fire inside the door or outside the door, and not capable of automatically opening the door based on the location of the fire. Even if there are some doors with temperature sensors, they cannot distinguish between inside fire and outside fire. In addition, someone may easily open the door by heating the sensor from outside. Therefore, in the technical solutions of the present disclosure, the first sensor and the second sensor are respectively installed on the inner and outer sides of the intelligent door body, which may individually sense the ambient temperature and/or smoke concentration inside and outside the door body, thereby distinguishing the ambient temperature and/or smoke concentration inside and outside the door.

In the technical solution of the present disclosure, the first sensor and the second sensor installed on the inner and outer sides of the intelligent door body may be used to determine whether a fire occurs inside or outside the door body, and then a suitable action may be carried out according to the fire situation. Further, in some exemplary embodiments of the present disclosure, the ambient temperature may be measured by a temperature sensor, and then compared with a temperature threshold; if the ambient temperature is higher than the temperature threshold, it may be determined that a fire occurs, and if the ambient temperature is not higher than the temperature threshold, it may be determined that no fire occurs. In some exemplary embodiments of the present disclosure, other suitable sensors may also be used to determine if a fire occurs, for example, the ambient smoke concentration may be measured by a smoke sensor. When the ambient smoke concentration is higher than a concentration threshold, it may be determined that a fire occurs, and if the ambient smoke concentration is not higher than the concentration threshold, it may be determined that no fire occurs. In addition, a temperature sensor and a smoke sensor may be used in combination, and it may be determined that a fire occurs when both the ambient temperature and the smoke concentration are higher than their respective thresholds, and it may be determined that no fire occurs when both the ambient temperature and the smoke concentration are lower than their respective thresholds.

In some exemplary embodiments of the present disclosure, the first sensor 110 and the second sensor 120 may be temperature sensors that sense temperature. In some exemplary embodiments of the present disclosure, the first sensor 110 and the second sensor 120 may be smoke concentration sensors that sense smoke concentration. In some exemplary embodiments of this disclosure, the first sensor 110 and the second sensor 120 may be sensors that sense temperature and smoke concentration at the same time. In some exemplary embodiments of the present disclosure, there may be more than one first sensor 110 and more than one second sensor 120, which may respectively sense temperature and smoke concentration.

In this embodiment, for ease of description, only a temperature sensor is taken as an example for explanation. However, it should be understood that this is not a limitation for this disclosure, and the temperature sensor may also be replaced by other sensors or instruments capable of determining fire conditions, such as smoke concentration sensors.

As shown in FIG. 1, the intelligent door control system may include a controller 130 which is in communication with the first sensor 110 and the second sensor 120. In some exemplary embodiments of the present disclosure, the controller 130 may be a processor.

In some exemplary embodiments of this disclosure, the operation modes of the controller 130 include a presence mode and an absence mode. The operation mode of the controller 130 may be the presence mode when there is a living body (e.g., a human being, an animal, etc.) inside the intelligent door, and the operation mode of the controller 130 may be the absence mode when there is no living body inside the intelligent door.

In some exemplary embodiments of this disclosure, the operation mode of the controller 130 may be manually set by a user, for example, a last person who exits a room, or a first person who enters a room. In addition, this may be done manually by a user or remotely by a client through communication with the intelligent door. For example, when the last person exits the room, to the controller may be set to the absence mode; when a first user enters the room, the controller may be set to the presence mode.

In some exemplary embodiments of the disclosure, the intelligent door control system may further include a living body detector arranged inside the door body and in communication with the controller 130, and the operation mode of the controller 130 may be automatically set according to a detection result of the living body detector. For example, when the living body detector detects that there is no living body in the room, the operation mode of the controller 130 may be automatically adjusted to the absence mode, and when the living body detector detects that there is a living body in the room, the operation mode of the controller 130 may be automatically adjusted to the presence mode.

In operation, the controller 130 may receive the ambient temperature inside the door sent by the first sensor 110 and the ambient temperature outside the door sent by the second sensor 120. After receiving the ambient temperatures inside the door sent by the first sensor 110 and outside the door sent by the second sensor 120, the controller 130 may compare the ambient temperature inside the door with a preset first temperature threshold, and compares the ambient temperature outside the door with a preset second temperature threshold.

In some exemplary embodiments of this disclosure, the ambient temperature may be compared with a temperature threshold, and then whether a fire occurs may be determined according to a comparison result. Therefore, the setting of the temperature threshold is very important. Since the ambient temperatures inside and outside the door body are usually different (for example, in winter, the outdoor temperature may be lower than the indoor temperature), different temperature thresholds may be set for the inside and outside ambient temperatures. specifically, the first temperature threshold may be set for the ambient temperature inside the door body and the second temperature threshold may be set for the ambient temperature outside of the door body.

In some exemplary embodiments of the present disclosure, the first temperature threshold may be 60 to 100 degrees Celsius, and the second temperature threshold may be 60 to 100 degrees Celsius. The temperature threshold may be a reference/basis for determining whether a fire occurs, so the temperature threshold should be distinguished from the limit temperature that may be reached inside or outside the door under normal conditions. For example, in hot summer, the upper limit temperature for inside and outside ambient temperatures may be about 50 degrees Celsius. Thus, setting the temperature threshold above 60 degrees Celsius means that there may be a fire when the indoor and outdoor temperature exceeds 60 degrees Celsius. Of course, when the first temperature threshold and the second temperature threshold are specifically set, certain adjustments and corrections may be made as needed.

In some exemplary embodiments of this disclosure, the controller 130 may also access local position information and weather information in real time. Since the climate difference may be significant between different regions and different seasons, the controller 130 may be used to access the local position information and weather information in real time, and predict the temperature limits of indoor and outdoor temperatures based on the recent weather and temperature conditions, or specifically the information of the last a few days or the same day, so as to adjust the first temperature threshold and the second temperature threshold. For example, in winter, the outdoor temperature may be low, and the indoor temperature may be high. Thus, the first temperature threshold may be adjusted higher, and the second temperature threshold may be adjusted lower. In summer, the outdoor temperature may be high, and the indoor temperature may be low. Hence, the first temperature threshold may be adjusted lower and the second temperature threshold may be adjusted higher.

In some exemplary embodiments of this disclosure, in order to more accurately determine the specific fire situation, in addition to comparing the indoor temperature (i.e., the temperature sensed by the first sensor) and the outdoor temperature (i.e., the temperature sensed by the second sensor) with the first temperature threshold and the second temperature threshold respectively, the indoor temperature and the outdoor temperature may also be compared to see if a difference between indoor and outdoor temperatures reaches a preset value. A comparison result between the indoor temperature and the first temperature threshold, a comparison result between the outdoor temperature and the second temperature threshold, and a comparison result between the indoor temperature and the outdoor temperature may be combined as a basis of the determination. For example, if the indoor temperature is higher than the first temperature threshold, it indicates that there is a fire in the room, in such a case, the outdoor temperature is not higher than the second temperature threshold and the indoor temperature is higher than the outdoor temperature, the difference between the indoor temperature and the outdoor temperature reaches a preset value, indicating that there is no fire outside.

The controller 130 may automatically control the intelligent door 140 according to the operation mode of the controller 130 and the comparison results. The operation mode herein refers to whether there is person or living body inside, and the comparison results herein refer to whether a fire occurs inside or outside.

TABLE 1

| Situation | Indoor | Outdoor | Operation mode | Operation |
|---|---|---|---|---|
| A | Fire | No fire | Presence | Open the door automatically |
| B | Fire | No fire | Absence | Notify users |
| C | No fire | Fire | Presence | Notify users |
| D | No fire | Fire | Absence | Notify users |
| E | Fire | Fire | Presence | Notify users |
| F | Fire | Fire | Absence | Notify users |

Table 1 lists the corresponding operations in different situations. It should be noted that the technical solution of this disclosure is used to automatically control the intelligent door when the temperature inside and/or outside the intelligent door is abnormal, so the situation that there is no fire indoors and outdoors (that is, there is no abnormality) is eliminated.

As shown in Table 1, when the situation A occurs, there is a fire indoors (i.e., the indoor temperature is higher than the first temperature threshold), there is no fire outdoors (i.e., the outdoor temperature is not higher than the second temperature threshold), and the operation mode is presence mode (i.e., there is living body indoor). Thus, in the case where the operation mode of the controller is presence mode, when the temperature inside the door body is higher than the first temperature threshold and the temperature outside the door body is not higher than the second temperature threshold, the door may be controlled to be opened automatically for people inside the door to escape.

In some exemplary embodiments of the present disclosure, after the door body is controlled to open automatically, the door body may be further controlled to stay in an open state to prevent the door to be closed by accident, such as by mis-operation or a wind.

In some exemplary embodiments of this disclosure, the controlling of the door body to stay in the open state may include: providing a lock body on the door body of the intelligent door, where the lock body may include a main lock tongue and an inclined tongue, and controlling the main lock tongue and the inclined tongue to retain inside the lock body.

In some exemplary embodiments of this disclosure, after controlling the door to stay in the open state, the user may need to restore the door to a normal state manually. For example, when the fire accident is over, the controller may be operated manually by the user to restore the door to the normal state, or a client connected with the intelligent door may send an instruction remotely to instruct the controller to restore the door to the normal state.

When the situation B occurs, there is a fire indoors (i.e., the indoor temperature is higher than the first temperature threshold), there is no fire outdoors (i.e., the outdoor temperature is not higher than the second temperature threshold), and the operation mode is the absence mode (i.e., there is no living body indoors), that is, when the operation mode of the controller is the absence mode, when the temperature inside the door body is higher than the first temperature threshold and the temperature outside the door body is not higher than the second temperature threshold, the user may be notified about the fire, specifically, an alarm may be automatically sent to a client (e.g., an application program (APP) installed on a mobile phone) in communication with the intelligent door. After receiving the alarm, the user may report the fire to the police department and/or fire department or go back home to take care of the fire. On the one hand, since there is no living body indoors, there is no need to open the door automatically, but to inform the user, and the user may determine a specific way to handle the accident. On the other hand, when there is no living body in the room, the system may notify the user instead of automatically opening the door to avoid the problem that the door is opened by someone by heating the door to trigger the sensor.

When the situation C occurs, there is no fire indoors (i.e., the indoor temperature is not higher than the first temperature threshold), there is a fire outdoors (i.e., the outdoor temperature is higher than the second temperature threshold), and the operation mode is the presence mode (i.e., there is living body indoors). Thus, in the case where the operation mode of the controller is the presence mode, when the temperature inside the door is not higher than the first temperature threshold and the temperature outside the door is higher than the second temperature threshold, the user may be notified about the fire. Specifically, an audio-visual acquisition device arranged outside the door body may be activated to acquire audio-visual information outside the door body, display the audio-visual information on a display device arranged inside the door body, and send the audio-visual information to a client (e.g., an application program (APP) installed on a mobile phone) in communication with the intelligent door. The user may evaluate the accident based on the audio-visual information to determine a suitable way to handle it, such as report the fire and/or escape leave the site (building).

When the situation D occurs, there is no fire indoors (i.e., the indoor temperature is not higher than the first temperature threshold), there is fire outdoors (i.e., the outdoor temperature is higher than the second temperature threshold), and the operation mode is the absence mode (i.e., there is no living body indoors). Thus, in the case where the operation mode of the controller is the absence mode, when the temperature inside the door is not higher than the first temperature threshold and the temperature outside the door is higher than the second temperature threshold, the user may be notified about the fire. Specifically, an audio-visual acquisition device arranged outside the door body may be activated to acquire audio-visual information outside the door body, and send the audio-visual information to a client (e.g., an application program (APP) installed on a mobile phone) in communication with the intelligent door. Since there is no living body in the room, it is not necessary to display the audio-visual information on the display device arranged inside the door body, and it only needs to notify the user remotely about the fire. The user may evaluate the accident based on the audio-visual information to determine a suitable way to handle it, such as report the fire and/or escape leave the site (building).

When the situation E occurs, there is a fire indoors (i.e., the indoor temperature is higher than the first temperature threshold) and there is also a fire outdoors (i.e., the outdoor temperature is higher than the second temperature threshold), and the operation mode is the presence mode (i.e., there is living body indoors). Thus, in the case where the operation mode of the controller is the presence mode, when the temperature inside the door is higher than the first temperature threshold and the temperature outside the door is higher than the second temperature threshold, the user is notified about the fires. Specifically, an audio-visual acquisition device arranged outside the door body may be activated to acquire audio-visual information outside the door body, display the audio-visual information on a display device arranged inside the door body, and send the audio-visual information to a client (e.g., an application program (APP) installed on a mobile phone) in communication with the intelligent door. The user may determine the degree of the danger (for example, outdoor is dangerous or indoor is dangerous) based on the audio-visual information, and decide whether to wait indoors for rescue, or open the door to escape or escape through other ways.

When the situation F occurs, there is a fire indoors (i.e., the indoor temperature is higher than the first temperature threshold) and there is a fire outdoors (i.e., the outdoor temperature is higher than the second temperature threshold), and the operation mode is the absence mode (i.e., there is no living body indoor). Thus, in the case where the operation mode of the controller is the absence mode, when the temperature inside the door is higher than the first temperature threshold and the temperature outside the door is higher than the second temperature threshold, the user is notified about the fires. Specifically, an audio-visual acquisition device arranged outside the door body may be activated to acquire audio-visual information outside the door body, and send the audio-visual information to a client (e.g., an application program (APP) installed on a mobile phone) in communication with the intelligent door. Since there is no living body in the room, it is not necessary to display the audio-visual information on the display device arranged inside the door body, and it only needs to notify the user remotely about the fires. The user may determine the degree of danger based on the audio-visual information, and decide whether to report the fire or contact people near the fires.

In some exemplary embodiments of the disclosure, the intelligent door control system may further include an alarm which is installed inside the door body of the intelligent door and is in communication with the controller, and automatically opens the intelligent door after receiving an automatic opening instruction from the controller. In situations A, C and E, in order to prevent the user from missing the information (for example, the user does not have the mobile phone with him) when sending the audio-visual information to the user, the alarm may also be controlled to alert the user. The alarm modes of the alarm may include: a voice alarm, a flashing alarm and a sound alarm.

In some exemplary embodiments of this disclosure, in each situation, when the door is opened automatically and the user is notified about the fire, the controller 130 may also issue a fire alarm, so as to avoid the case that the user does not check the information in time or the user does not report the fire in time.

According to the present disclosure, the intelligent door control system includes sensors installed on the inner and outer sides of the intelligent door body for determining whether a fire occurs, and then automatically opens the door based on the fire situation for people to escape, or notifies the user about the fire.

Figure 2:
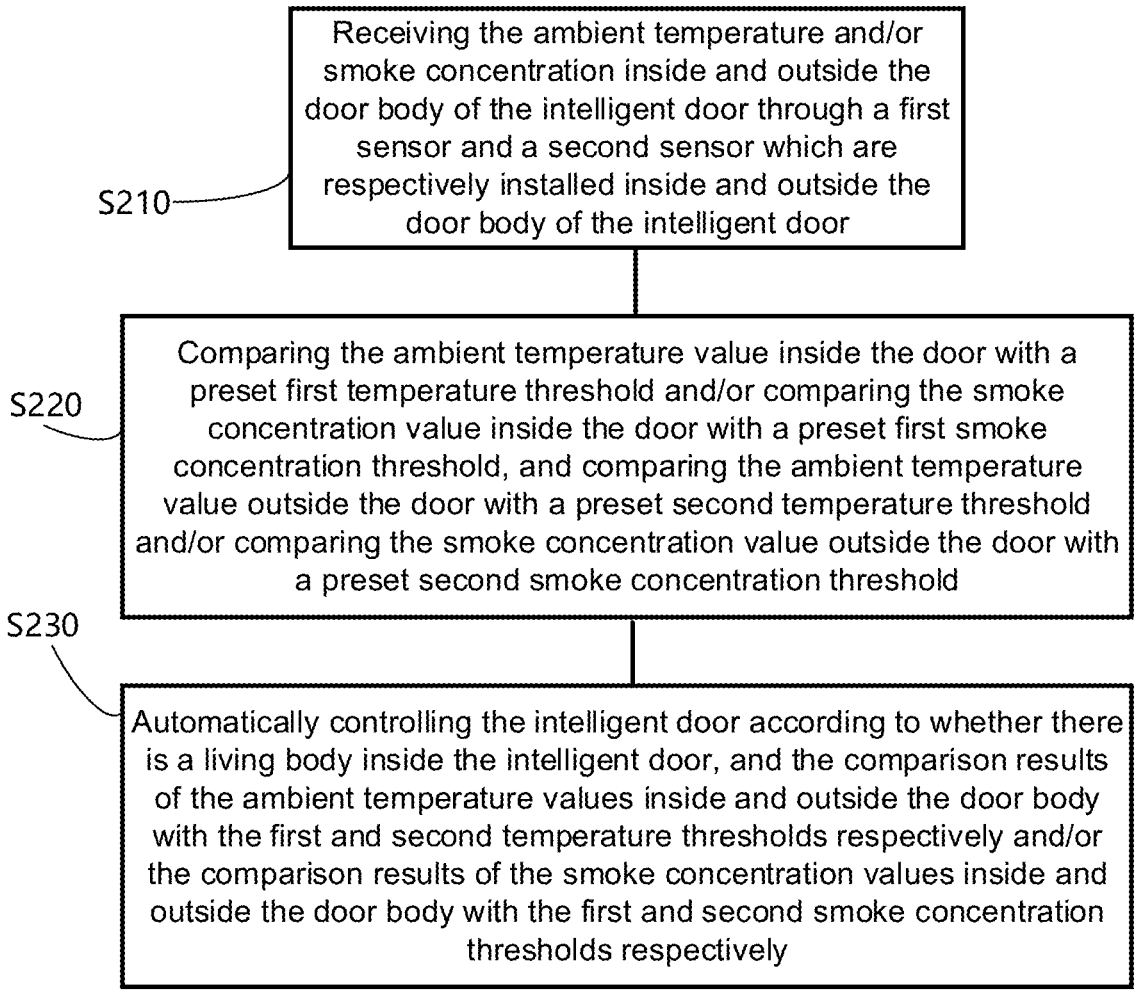
FIG. 2 is a flowchart of an intelligent door control method according to some exemplary embodiments of the present disclosure.

FIG. 2 is a flowchart of an intelligent door control method according to some exemplary embodiments of the present disclosure. The intelligent door control system is described in further detail below in conjunction with FIG. 2.

The embodiments of the present application also provides a intelligent door control method, which is used to automatically control the intelligent door when the temperature inside and outside the intelligent door is abnormal, including: a controller of the intelligent door: receiving an ambient temperature and/or a smoke concentration inside and outside a door body of the intelligent door through a first sensor and a second sensor which are respectively installed inside and outside the door body of the intelligent door; comparing the ambient temperature inside the door with a preset first temperature threshold and/or comparing the smoke concentration inside the door with a preset first smoke concentration threshold, and comparing the ambient temperature outside the door with a preset second temperature threshold and/or comparing the smoke concentration outside the door with a preset second smoke concentration threshold; and automatically controlling the intelligent door according to whether there is a living body inside the intelligent door, and the comparison results of the ambient temperatures inside and outside the door body with the first and second temperature thresholds respectively and/or the comparison results of the smoke concentrations inside and outside the door body with the first and second smoke concentration thresholds respectively.

As shown in FIG. 2, the intelligent door control method of the present disclosure may include:

Step S210: Receive an ambient temperature and/or a smoke concentration inside and outside the door body of the intelligent door through a first sensor and a second sensor which are respectively installed inside and outside the door body of the intelligent door;

Step S220: Compare the ambient temperature inside the door with a preset first temperature threshold and/or comparing the smoke concentration inside the door with a preset first smoke concentration threshold, and compare the ambient temperature outside the door with a preset second temperature threshold and/or comparing the smoke concentration outside the door with a preset second smoke concentration threshold; and Step S230: automatically controlling the intelligent door according to whether there is a living body inside the intelligent door, and the comparison results of the ambient temperatures inside and outside the door body with the first and second temperature thresholds respectively and/or the comparison results of the smoke concentrations inside and outside the door body with the first and second smoke concentration thresholds respectively.

As shown in FIG. 2, step S210 includes receiving the ambient temperature and/or smoke concentration inside and outside the door body of the intelligent door through a first sensor and a second sensor which are respectively installed inside and outside the door body of the intelligent door. Specifically, the first sensor and the second sensor send the sensed ambient temperatures and/or smoke concentrations to the controller.

At present, the traditional mechanical doors on the market may not judge whether there is a fire indoors or outdoors, and may not automatically open the doors according to the fire situation. Even if there are some doors with temperature sensors installed, there is no distinction between indoors and outdoors, and people outside the doors may use the temperature sensors to open the doors, which has potential safety hazards. Therefore, In the technical solution of the present disclosure, the first sensor and the second sensor are respectively installed on the inner and outer sides of the intelligent door body, which may individually sense the ambient temperature and/or smoke concentration inside and outside the door body. This distinguishes the ambient temperature and/or smoke concentration inside and outside the door.

In the technical solution of the present disclosure, the first sensor and the second sensor installed on the inner and outer sides of the intelligent door body are used to determine whether a fire occurs inside or outside the door body, and then the next action may be carried out according to the fire situation. Further, in some exemplary embodiments of the present disclosure, the ambient temperature may be measured by a temperature sensor, and then compared with a temperature threshold; if the ambient temperature is higher than the temperature threshold, it may be determined that a fire occurs; if the ambient temperature is not higher than the temperature threshold, it may be determined that no fire occurs. In some exemplary embodiments of the present disclosure, other suitable types of sensors may also be used for determining if a fire occurs. For example, an ambient smoke concentration may be measured by a smoke sensor. When the ambient smoke concentration is higher than a concentration threshold, it may be determined that a fire occurs, and if the ambient smoke concentration is not higher than the concentration threshold, it may be determined that no fire occurs. In addition, a temperature sensor and a smoke sensor may be used in combination, and it may be determined that a fire occurs when both the ambient temperature and the smoke concentration are higher than corresponding thresholds, and that no fire occurs when both the ambient temperature and the smoke concentration are lower than corresponding thresholds.

In some exemplary embodiments of the present disclosure, the first sensor 110 and the second sensor 120 may be temperature sensors that sense temperature. In some exemplary embodiments of the present disclosure, the first sensor 110 and the second sensor 120 may be smoke concentration sensors that sense smoke concentration. In some exemplary embodiments of this disclosure, the first sensor 110 and the second sensor 120 may be sensors that sense temperature and smoke concentration at the same time. In some exemplary embodiments of the present disclosure, there are may be multiple first sensors 110 and multiple second sensors 120, which respectively sense temperature and smoke concentration.

For ease of description, only the temperature sensor is taken as an example for explanation. However, it should be understood that this is not a limitation to this disclosure, and the temperature sensor may also be replaced by other sensors or instruments for determining fire situations, such as smoke concentration sensors.

The controller 130 is in communication with the first sensor 110 and the second sensor 120 at the same time.

In some exemplary embodiments of this disclosure, the operation modes of the controller 130 may include a presence mode and a absence mode. The operation mode of the controller 130 is the presence mode when there is a living body inside the intelligent door, and the operation mode of the controller 130 is the absence mode when there is no living body inside the intelligent door.

In some exemplary embodiments of this disclosure, the operation mode of the controller 130 may be manually set by a user, for example, a last person who exits a room, or a first person who enters a room. In addition, this may be done manually by a user or remotely by a client through communication with the intelligent door. For example, when the last person exits the room, to the controller may be set to the absence mode; when a first user enters the room, the controller may be set to the presence mode.

In some exemplary embodiments of the disclosure, the intelligent door control system may further include a living body detector arranged inside the door body and in communication with the controller 130, and the operation mode of the controller 130 may be automatically set according to a detection result of the living body detector. For example, when the living body detector detects that there is no living body in the room, the operation mode of the controller 130 may be automatically adjusted to the absence mode, and when the living body detector detects that there is a living body in the room, the operation mode of the controller 130 may be automatically adjusted to the presence mode.

As shown in FIG. 2, step S220 includes comparing the ambient temperature inside the door with a preset first temperature threshold and/or comparing the smoke concentration inside the door with a preset first smoke concentration threshold, and comparing the ambient temperature outside the door with a preset second temperature threshold and/or the smoke concentration outside the door is compared with a preset second smoke concentration threshold.

After receiving the ambient temperature inside the door sent by the first sensor 110 and the ambient temperature outside the door sent by the second sensor 120, the controller 130 may compare the ambient temperature inside the door with a preset first temperature threshold, and compare the ambient temperature outside the door with a preset second temperature threshold.

In some exemplary embodiments of this disclosure, the ambient temperature is compared with a temperature threshold, and then whether a fire occurs is determined according to the comparison result. Therefore, the setting of the temperature threshold is very important. Since the ambient temperatures inside and outside the door body are usually different (for example, in winter, the outdoor temperature may be lower than the indoor temperature), different temperature thresholds may be set for the inside and outside ambient temperatures, specifically, the first temperature threshold may be set for the inside ambient temperature of the door body and the second temperature threshold may be set for the outside ambient temperature of the door body.

In some exemplary embodiments of the present disclosure, the first temperature threshold may be 60 to 100 degrees Celsius, and the second temperature threshold may be 60 to 100 degrees Celsius. The temperature threshold may be a reference/basis for determining whether a fire occurs, so the temperature threshold should be distinguished from the limit temperature that may be reached indoors and outdoors under normal conditions. For example, in hot summer, the upper limit temperature for inside and outside ambient temperatures may be about 50 degrees Celsius. Thus, setting the temperature threshold above 60 degrees Celsius means that there may be a fire when the indoor and outdoor temperature exceeds 60 degrees Celsius. Of course, when the first temperature threshold and the second temperature threshold are specifically set, certain adjustments and corrections may be made as needed.

In some exemplary embodiments of this disclosure, the controller 130 may also access local position information and weather information in real time. Since the climate difference may be significant between different regions and different seasons, the controller 130 may be used to access the local position information and weather information in real time, and predict the temperature limits of indoor and outdoor temperatures based on the recent weather and temperature conditions, or specifically the information of the last a few days or the same day, so as to adjust the first temperature threshold and the second temperature threshold. For example, in winter, the outdoor temperature may be low, and the indoor temperature may be high. Thus, the first temperature threshold may be adjusted higher, and the second temperature threshold may be adjusted lower. In summer, the outdoor temperature may be high, and the indoor temperature may be low. Hence, the first temperature threshold may be adjusted lower and the second temperature threshold may be adjusted higher.

In some exemplary embodiments of this disclosure, in order to more accurately determine the fire situation, in addition to comparing the indoor temperature (i.e., the temperature sensed by the first sensor) and the outdoor temperature (i.e., the temperature sensed by the second sensor) with the first temperature threshold and the second temperature threshold respectively, the indoor temperature and the outdoor temperature may also be compared to see if a difference between indoor and outdoor temperatures reaches a preset value. A comparison result between the indoor temperature and the first temperature threshold, a comparison result between the outdoor temperature and the second temperature threshold, and a comparison result between the indoor temperature and the outdoor temperature may be combined as a basis of the determination. For example, if the indoor temperature is higher than the first temperature threshold, it indicates that there is a fire in the room, in such a case, the outdoor temperature is not higher than the second temperature threshold and the indoor temperature is higher than the outdoor temperature, the difference between the indoor temperature and the outdoor temperature reaches a preset value, indicating that there is no fire outside.

As shown in FIG. 2, in step S230, The intelligent door is automatically controlled based on whether there is a living body inside the intelligent door, and the comparison results of the ambient temperatures inside and outside the door body with the first and second temperature thresholds respectively and/or the comparison results of the smoke concentrations inside and outside the door body with the first and second smoke concentration thresholds respectively. The specific operation mode indicates whether there is living body indoors, and the comparison results indicate whether there is a fire indoors or outdoors.

As shown in Table 1, when the situation A occurs, there is a fire indoors (i.e., the indoor temperature is higher than the first temperature threshold), there is no fire outdoors (i.e., the outdoor temperature is not higher than the second temperature threshold), and the operation mode is the presence mode (i.e., there is living body indoor). Thus, in the case where the operation mode of the controller is the presence mode, when the temperature inside the door body is higher than the first temperature threshold and the temperature outside the door body is not higher than the second temperature threshold, the door may be controlled to be opened automatically for people inside the door to escape.

In some exemplary embodiments of the present disclosure, after the door body is controlled to open automatically, the door body may be further controlled to stay in an open state to prevent the door to be closed by accident, such as by mis-operation or a wind.

In some exemplary embodiments of this disclosure, the controlling of the door body to stay in the open state may include: providing a lock body on the door body of the intelligent door, where the lock body may include a main lock tongue and an inclined tongue, and controlling the main lock tongue and the inclined tongue to retain inside the lock body.

In some exemplary embodiments of this disclosure, after controlling the door to stay in the open state, the user may need to restore the door to a normal state manually. For example, when the fire accident is over, the controller may be operated manually by the user to restore the door to the normal state, or a client connected with the intelligent door may send an instruction remotely to instruct the controller to restore the door to the normal state.

When the situation B occurs, there is a fire indoors (i.e., the indoor temperature is higher than the first temperature threshold), there is no fire outdoors (i.e., the outdoor temperature is not higher than the second temperature threshold), and the operation mode is the absence mode (i.e., there is no living body indoors). Thus, in the case where the operation mode of the controller is the absence mode, when the temperature inside the door body is higher than the first temperature threshold and the temperature outside the door body is not higher than the second temperature threshold, the user may be notified about the fire, specifically, an alarm may be automatically sent to a client (e.g., an application program (APP) installed on a mobile phone) in communication with the intelligent door. After receiving the alarm, the user may report the fire to the police department and/or fire department or go back home to take care of the fire. On the one hand, since there is no living body indoors, there is no need to open the door automatically, but to inform the user, and the user may determine a specific way to handle the accident. On the other hand, when there is no living body in the room, the system may notify the user instead of automatically opening the door to avoid the problem that the door is opened by someone by heating the door to trigger the sensor.

When the situation C occurs, there is no fire indoors (i.e., the indoor temperature is not higher than the first temperature threshold), there is fire outdoors (i.e., the outdoor temperature is higher than the second temperature threshold), and the operation mode is the presence mode (i.e., there is a living body indoors). Thus, in the case where the operation mode of the controller is the presence mode, when the temperature inside the door is not higher than the first temperature threshold and the temperature outside the door is higher than the second temperature threshold, the user may be notified about the fire. Specifically, an audio-visual acquisition device arranged outside the door body may be activated to acquire audio-visual information outside the door body, display the audio-visual information on a display device arranged inside the door body, and send the audio-visual information to a client (e.g., an application program (APP) installed on a mobile phone) in communication with the intelligent door. The user may evaluate the accident based on the audio-visual information to determine a suitable way to handle it, such as report the fire and/or escape leave the site (building).

When the situation D occurs, there is no fire indoors (i.e., the indoor temperature is not higher than the first temperature threshold), there is fire outdoors (i.e., the outdoor temperature is higher than the second temperature threshold), and the operation mode is the absence mode (i.e., there is no living body indoors). Thus, in the case where the operation mode of the controller is the absence mode, when the temperature inside the door is not higher than the first temperature threshold and the temperature outside the door is higher than the second temperature threshold, the user may be notified about the fire. Specifically, an audio-visual acquisition device arranged outside the door body may be activated to acquire audio-visual information outside the door body, and send the audio-visual information to a client (e.g., an application program (APP) installed on a mobile phone) in communication with the intelligent door. Since there is no living body in the room, it is not necessary to display the audio-visual information on the display device arranged inside the door body, and it only needs to notify the user remotely about the fire. The user may evaluate the accident based on the audio-visual information to determine a suitable way to handle it, such as report the fire and/or escape leave the site (building).

When the situation E occurs, there is a fire indoors (i.e., the indoor temperature is higher than the first temperature threshold) and there is also a fire outdoors (i.e., the outdoor temperature is higher than the second temperature threshold), and the operation mode is the presence mode (i.e., there is living body indoors). Thus, in the case where the operation mode of the controller is the presence mode, when the temperature inside the door is higher than the first temperature threshold and the temperature outside the door is higher than the second temperature threshold, the user is notified about the fires. Specifically, an audio-visual acquisition device arranged outside the door body may be activated to acquire audio-visual information outside the door body, display the audio-visual information on a display device arranged inside the door body, and send the audio-visual information to a client (e.g., an application program (APP)

installed on a mobile phone) in communication with the intelligent door. The user may determine the degree of the danger (for example, outdoor is dangerous or indoor is dangerous) based on the audio-visual information, and decide whether to wait indoors for rescue, or open the door to escape through other ways.

When the situation F occurs, there is a fire indoors (i.e., the indoor temperature is higher than the first temperature threshold) and there is a fire outdoors (i.e., the outdoor temperature is higher than the second temperature threshold), and the operation mode is the absence mode (i.e., there is no living body indoor). Thus, in the case where the operation mode of the controller is the absence mode, when the temperature inside the door is higher than the first temperature threshold and the temperature outside the door is higher than the second temperature threshold, the user is notified about the fires. Specifically, an audio-visual acquisition device arranged outside the door body may be activated to acquire audio-visual information outside the door body, and send the audio-visual information to a client (e.g., an application program APP installed on a mobile phone) in communication with the intelligent door. Since there is no living body in the room, so it is not necessary to display the audio-visual information on the display device arranged inside the door body, and it only needs to notify the user remotely about the fires. The user may determine the degree of danger based on the audio-visual information, and decide whether to report the fire or contact people near the fires.

In some exemplary embodiments of the disclosure, the intelligent door control system may further include an alarm which is installed inside the door body of the intelligent door and is in communication with the controller, and automatically opens the intelligent door after receiving an automatic opening instruction from the controller. In situations A, C and E, in order to prevent the user from missing the information (for example, the user does not have the mobile phone with him) when sending the audio-visual information to the user, the alarm may also be controlled to alert the user. The alarm modes of the alarm may include: a voice alarm, a flashing alarm and a sound alarm.

In some exemplary embodiments of this disclosure, in each situation, when the door is opened automatically and the user is notified about the fire, the controller 130 may also issue a fire alarm, so as to avoid the case that the user does not check the information in time or the user does not report the fire in time.

According to the present disclosure, the intelligent door control system includes sensors installed on the inner and outer sides of the intelligent door body for determining a fire occurs, and then automatically opens the door based on the fire situation for people to escape, or notifies the user to about the fire.

Figure 3:
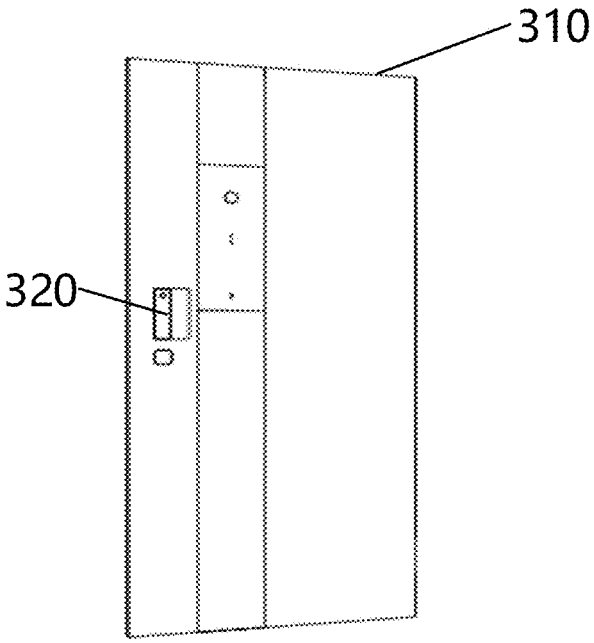
FIG. 3 is a schematic structural diagram of an outer side of an intelligent door body according to some exemplary embodiments of the present disclosure.
Figure 4:
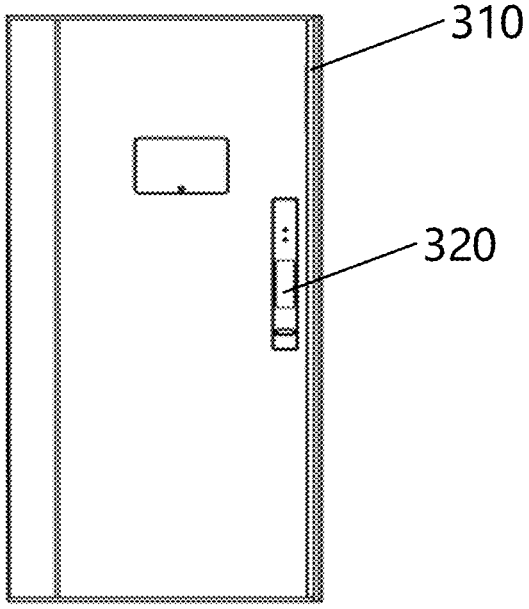
FIG. 4 is a schematic structural diagram of an inner side of an intelligent door according to some exemplary embodiments of this disclosure.
Figure 5:
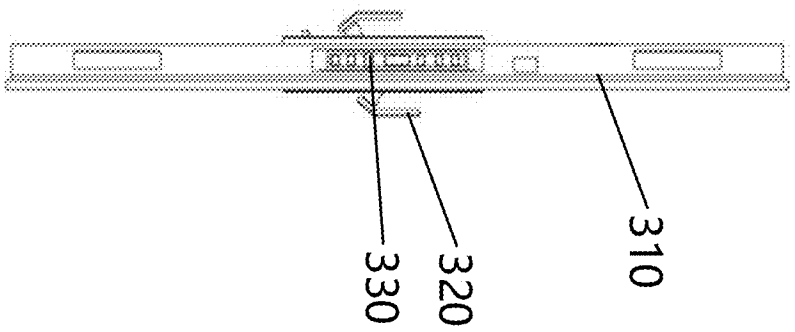
FIG. 5 is a structural schematic diagram of a side surface of an intelligent door according to some exemplary embodiments of this disclosure.

FIG. 3 is a schematic structural diagram of the outer side of the intelligent door body according to some exemplary embodiments of the present disclosure. FIG. 4 is a schematic structural diagram of the inner side of the intelligent door according to some exemplary embodiments of this disclosure. FIG. 5 is a structural schematic diagram of a side surface of the intelligent door according to some exemplary embodiments of this disclosure.

As shown in FIG. 3, FIG. 4 and FIG. 5, embodiments of the present disclosure also provide an intelligent door, including: a door body 310; a first sensor installed on the inside of the door body 310 (i.e., the indoor side of the door body) for sensing the ambient temperature and/or smoke concentration inside the door body (i.e., smoke concentration at indoor side of the door body); a second sensor installed on an outside of the door body (i.e., the outdoor side of the door body) for sensing the ambient temperature and/or smoke concentration at the outside of the door body (i.e., smoke concentration at the outdoor side of the door body); a controller which is in communication with the first sensor and the second sensor at the same time, receives temperatures and/or smoke concentrations inside and outside the door body from the first sensor and the second sensor, and compares the ambient temperatures inside the door body with a preset first temperature threshold and/or compares the smoke concentrations inside the door body with a preset first smoke concentration threshold, comparing the ambient temperature outside the door body with a preset second temperature threshold and/or comparing the smoke concentration outside the door body with a preset second smoke concentration threshold, and automatically controlling the intelligent door based on whether there is a living body inside the intelligent door and the comparison results between the ambient temperatures inside and outside the door body and the first and second temperature thresholds respectively.

As shown in FIG. 3, FIG. 4 and FIG. 5, the door body 310 of the intelligent door may be further provided with a lock body 320 for locking the door. The first sensor may be installed on one side of the lock body 320 located inside the door body (such as an inner door handle). The second sensor may be installed on one side of the lock body 320 located outside the door body (such as an outer door handle). In some exemplary embodiments, when there are other electronic devices on the door body, the first sensor and the second sensor may be installed close to the electronic devices to save wires.

In some exemplary embodiments of the present disclosure, the first sensor and the second sensor may be integrally installed on the lock body 320 when forming the lock body 320 to prevent the first sensor and the second sensor from being easily visible or damageable. In some exemplary embodiments of this disclosure, the first sensor and the second sensor may also be detachably arranged on the lock body 320, for example, after the lock body 320 is formed, they may be externally attached to the lock body 320 by screws and nuts to allow the first sensor and the second sensor to be easily replaced or repaired.

The lock body 320 may further include a main lock tongue and an inclined tongue 330, and the lock body 320 locks the door through the main lock tongue and the incline tongue 330. As shown in FIG. 5, when the door body is closed, the main lock tongue and incline tongue 330 extend out of the lock body 320 to lock the door. When the main lock tongue and inclined tongue 320 are retracted into the lock body 320, the door may not be locked.

The controller may be installed on or in the door body, and the controller may be, for example, a processor. The controller may be arranged in the door body, and interacts with a user through a client which is in communication with the controller. The controller may further include button(s) and touch screen(s) exposed on the inner and/or outer sides of the door body, and interact with the user through the buttons and touch screens. For example, the user may set the operation mode through a certain button or touch screen.

In some exemplary embodiments of the disclosure, the intelligent door may further include an audio-visual acquisition device (such as a camera) installed outside the door body for acquiring audio-visual information outside the door body; a display device (e.g., a display screen) installed inside the door body for displaying the audio-visual information acquired by the audio-visual acquisition device; the audio-visual acquisition device and the display device are in communication with the controller, and are automatically turned on after receiving an automatic turn-on instruction from the controller.

In some exemplary embodiments of the disclosure, the intelligent door may further include an alarm (such as a warning light, a siren, etc.), which may be installed inside the door body of the intelligent door and in communication with the controller, and automatically activated after receiving an automatic opening instruction from the controller. The alarm modes of the alarm include: a voice alarm, a flashing alarm, and a sound alarm.

As shown in FIG. 3, the ambient temperature and/or smoke concentration inside or outside the intelligent door body may be obtained simultaneously by the first sensor and the second sensor respectively installed at the inner and outer sides of the intelligent door body. Further, the first sensor and the second sensor may send the sensed ambient temperature and/or smoke concentration to the controller.

At present, the traditional mechanical doors on the market may not judge whether there is a fire indoors or outdoors, and may not automatically open the doors according to the fire situation. Even if there are some doors with temperature sensors installed, there is no distinction between indoors and outdoors, and people outside the doors may use the temperature sensors to open the doors, which has potential safety hazards. Therefore, in the technical solution of the present disclosure, the first sensor and the second sensor are installed on the inner and outer sides of the intelligent door body, which may respectively sense the ambient temperature and/or smoke concentration inside and outside the door body, and distinguish the ambient temperature and/or smoke concentration inside and outside the door.

In the technical solution of the present disclosure, the first sensor and the second sensor installed on the inner and outer sides of the intelligent door body may be used to determine whether a fire occurs inside or outside the door body, and then the next action may be carried out according to the fire situation. Further, in some exemplary embodiments of the present disclosure, the ambient temperature may be measured by a temperature sensor, and then compared with a temperature threshold; if the ambient temperature is higher than the temperature threshold, it may be determined that a fire occurs, and if the ambient temperature is not higher than the temperature threshold, it may be determined that no fire occurs. In some exemplary embodiments of the present disclosure, other suitable types of sensors may be used for determining if a fire occurs. For example, an ambient smoke concentration may be measured by a smoke sensor. When the ambient smoke concentration is higher than a concentration threshold, it may be determined that a fire occurs, and if the ambient smoke concentration is not higher than the concentration threshold, it may be determined that no fire occurs. In addition, a temperature sensor and a smoke sensor may be used in combination, and it may be determined that a fire occurs when both the ambient temperature and the smoke concentration are higher than corresponding thresholds, and that no fire occurs when both the ambient temperature and the smoke concentration are lower than corresponding thresholds.

In some exemplary embodiments of the present disclosure, the first sensor 110 and the second sensor 120 are temperature sensors that sense temperature. In some exemplary embodiments of the present disclosure, the first sensor 110 and the second sensor 120 are smoke concentration sensors that sense smoke concentration. In some exemplary embodiments of this disclosure, the first sensor 110 and the second sensor 120 may be sensors that sense temperature and smoke concentration at the same time. In some exemplary embodiments of the present disclosure, there are may be multiple first sensors 110 and multiple second sensors 120, which respectively sense temperature and smoke concentration.

For ease of description, only the temperature sensor is taken as an example for explanation. However, it should be understood that this is not a limitation to this disclosure, and the temperature sensor may also be replaced by other sensors or instruments for determining fire situations, such as smoke concentration sensors.

The controller 130 of the intelligent door is in communication with the first sensor 110 and the second sensor 120 at the same time.

In some exemplary embodiments of this disclosure, the operation modes of the controller 130 may include a presence mode and a absence mode. The operation mode of the controller 130 is presence mode when there is a living body inside the intelligent door, and the operation mode of the controller 130 is absence mode when there is no living body inside the intelligent door.

In some exemplary embodiments of this disclosure, the operation mode of the controller 130 may be manually set by a user, for example, a last person who exits a room, or a first person who enters a room. In addition, this may be done manually by a user or remotely by a client through communication with the intelligent door. For example, when the last person exits the room, to the controller may be set to the absence mode; when a first user enters the room, the controller may be set to the presence mode.

In some exemplary embodiments of the disclosure, the intelligent door control system may further include a living body detector arranged inside the door body and in communication with the controller 130, and the operation mode of the controller 130 may be automatically set according to a detection result of the living body detector. For example, when the living body detector detects that there is no living body in the room, the operation mode of the controller 130 may be automatically adjusted to the absence mode, and when the living body detector detects that there is a living body in the room, the operation mode of the controller 130 may be automatically adjusted to the presence mode.

After receiving the ambient temperature inside the door sent by the first sensor 110 and the ambient temperature outside the door sent by the second sensor 120, the controller 130 may compare the ambient temperature inside the door with a preset first temperature threshold, and compare the ambient temperature outside the door with a preset second temperature threshold.

In some exemplary embodiments of this disclosure, the ambient temperature is compared with a temperature threshold, and then whether a fire occurs is determined according to the comparison result. Therefore, the setting of the temperature threshold is very important. Since the ambient temperatures inside and outside the door body are usually different (for example, in winter, the outdoor temperature may be lower than the indoor temperature), different temperature thresholds may be set for the inside and outside ambient temperatures of the door body, specifically, the first temperature threshold may be set for the inside ambient temperature of the door body and the second temperature threshold may be set for the outside ambient temperature of the door body.

In some exemplary embodiments of the present disclosure, the first temperature threshold may be 60 to 100 degrees Celsius, and the second temperature threshold may be 60 to 100 degrees Celsius. The temperature threshold may be a reference/basis for determining whether a fire occurs, so the temperature threshold should be distinguished from the limit temperature that may be reached indoors and outdoors under normal conditions. For example, in hot summer, the upper limit temperature for inside and outside ambient temperatures may be about 50 degrees Celsius, Thus, setting the temperature threshold above 60 degrees Celsius means that there may be a fire when the indoor and outdoor temperature exceeds 60 degrees Celsius. Of course, when the first temperature threshold and the second temperature threshold are specifically set, certain adjustments and corrections may be made as needed.

In some exemplary embodiments of this disclosure, the controller 130 may also access local position information and weather information in real time. Since the climate difference may be significant between different regions and different seasons, the controller 130 may be used to access the local position information and weather information in real time, and predict the temperature limits of indoor and outdoor temperatures based on the recent weather and temperature conditions, or specifically the information of the last a few days or the same day, so as to adjust the first temperature threshold and the second temperature threshold. For example, in winter, the outdoor temperature may be low, and the indoor temperature may be high. Thus, the first temperature threshold may be adjusted higher, and the second temperature threshold may be adjusted lower. In summer, the outdoor temperature may be high, and the indoor temperature may be low. Hence, the first temperature threshold may be adjusted lower and the second temperature threshold may be adjusted higher.

In some exemplary embodiments of this disclosure, in order to more accurately determine the fire situation, in addition to comparing the indoor temperature (i.e., the temperature sensed by the first sensor) and the outdoor temperature (i.e., the temperature sensed by the second sensor) with the first temperature threshold and the second temperature threshold respectively, the indoor temperature and the outdoor temperature may also be compared to see a difference between indoor and outdoor temperatures reaches a preset value. A comparison result between the indoor temperature and the first temperature threshold, a comparison result between the outdoor temperature and the second temperature threshold, and a comparison result between the indoor temperature and the outdoor temperature may be combined as a basis of the determination. For example, if the indoor temperature is higher than the first temperature threshold, it indicates that there is a fire in the room, in such a case, the outdoor temperature is not higher than the second temperature threshold and the indoor temperature is higher than the outdoor temperature, the difference between the indoor temperature and the outdoor temperature reaches a preset value, indicating that there is no fire outside.

The controller 130 also automatically controls the intelligent door 140 based on the operation mode of the controller 130 and the comparison result. The specific operation mode indicates whether there is living body indoors, and the comparison results indicate whether there is a fire indoors or outdoors.

As shown in Table 1, when the situation A occurs, there is a fire indoors (i.e., the indoor temperature is higher than the first temperature threshold), there is no fire outdoors (i.e., the outdoor temperature is not higher than the second temperature threshold), and the operation mode is the presence mode (i.e., there is living body indoor), Thus, in the case where the operation mode of the controller is the presence mode, when the temperature inside the door body is higher than the first temperature threshold and the temperature outside the door body is not higher than the second temperature threshold, the door body 310 may be controlled to be opened automatically for people to escape. Specifically, the main lock tongue and inclined tongue 330 on the lock body 320 of the door body 310 may be controlled to retract into the lock body 320 so as to open the door body 310.

In some exemplary embodiments of the present disclosure, after the door body is controlled to open automatically, the door body may be further controlled to stay in an open state to prevent the door to be closed by accident, such as by mis-operation or a wind.

In some exemplary embodiments of this disclosure, the method of further controlling the door body to stay in an open state may include: controlling the main lock tongue and the inclined tongue to stay in the lock body.

In some exemplary embodiments of this disclosure, after controlling the door to stay in the open state, the user may need to restore the door to a normal state manually. For example, when the fire accident is over, the controller may be operated manually by the user to restore the door to the normal state, or a client connected with the intelligent door may send an instruction remotely to instruct the controller to restore the door to the normal state.

When the situation B occurs, there is a fire indoors (i.e., the indoor temperature is higher than the first temperature threshold), there is no fire outdoors (i.e., the outdoor temperature is not higher than the second temperature threshold), and the operation mode is the absence mode (i.e., there is no living body indoor). Thus, in the case where the operation mode of the controller is the absence mode, when the temperature inside the door body is higher than the first temperature threshold and the temperature outside the door body is not higher than the second temperature threshold, the user may be notified about the fire, specifically, an alarm may be automatically sent to a client (e.g., an application program (APP) installed on a mobile phone) in communication with the intelligent door. After receiving the alarm, the user may report the fire to the police department and/or fire department or go back home to take care of the fire. On the one hand, since there is no living body indoors, there is no need to open the door automatically, but to inform the user, and the user may determine a specific way to handle the accident. On the other hand, when there is no living body in the room, the system may notify the user instead of automatically opening the door to avoid the problem that the door is opened by someone by heating the door to trigger the sensor.

When the situation C occurs, there is no fire indoors (i.e., the indoor temperature is not higher than the first temperature threshold), there is fire outdoors (i.e., the outdoor temperature is higher than the second temperature threshold), and the operation mode is the presence mode (i.e., there is a living body indoor), that is, when the operation mode of the controller is the presence mode, when the temperature inside the door is not higher than the first temperature threshold and the temperature outside the door is not higher than the second temperature threshold, the user may be notified about the fire. Specifically, the audio-visual acquisition device arranged outside the door body may be activated to acquire audio-visual information outside the door body, display the audio-visual information on the display device arranged inside the door body, and send the audio-visual information to a client (e.g., an application program (APP) installed on a mobile phone) in communication with the intelligent door. The user may evaluate the accident based on the audio-visual information to determine a suitable way to handle it, such as report the fire and/or escape leave the site (building).

When the situation D occurs, there is no fire indoors (i.e., the indoor temperature is not higher than the first temperature threshold), there is fire outdoors (i.e., the outdoor temperature is higher than the second temperature threshold), and the operation mode is the absence mode (i.e., there is no living body indoors). Thus, in the case where the operation mode of the controller is the absence mode, when the temperature inside the door is not higher than the first temperature threshold and the temperature outside the door is higher than the second temperature threshold, the user may be notified about the fire. Specifically, the audio-visual acquisition device arranged outside the door body may be activated to acquire audio-visual information outside the door body, and send the audio-visual information to a client (e.g., an application program (APP) installed on a mobile phone) in communication with the intelligent door. Since there is no living body in the room, it is not necessary to display the audio-visual information on the display device arranged inside the door body, and it only needs to notify the user remotely about the fire. The user may evaluate the accident based on the audio-visual information to determine a suitable way to handle it, such as report the fire and/or escape leave the site (building).

When the situation E occurs, there is a fire indoors (i.e., the indoor temperature is higher than the first temperature threshold) and there is also a fire outdoors (i.e., the outdoor temperature is higher than the second temperature threshold), and the operation mode is the presence mode (i.e., there is living body indoors). Thus, in the case where the operation mode of the controller is the presence mode, when the temperature inside the door is higher than the first temperature threshold and the temperature outside the door is higher than the second temperature threshold, the user is notified about the fires. Specifically, the audio-visual acquisition device arranged outside the door body may be activated to acquire audio-visual information outside the door body, display the audio-visual information on the display device arranged inside the door body, and send the audio-visual information to a client (e.g., an application program (APP) installed on a mobile phone) in communication with the intelligent door. The user may determine the degree of the danger (for example, outdoor is dangerous or indoor is dangerous) based on the audio-visual information, and decide whether to wait indoors for rescue, or open the door to escape through other ways.

When the situation F occurs, there is a fire indoors (i.e., the indoor temperature is higher than the first temperature threshold) and there is a fire outdoors (i.e., the outdoor temperature is higher than the second temperature threshold), and the operation mode is the absence mode (i.e., there is no living body indoor). Thus, in the case where the operation mode of the controller is the absence mode, when the temperature inside the door is higher than the first temperature threshold and the temperature outside the door is higher than the second temperature threshold, the user is notified about the fires. Specifically, the audio-visual acquisition device arranged outside the door body may be activated to acquire audio-visual information outside the door body, and send the audio-visual information to a client (e.g., an application program APP installed on a mobile phone) in communication with the intelligent door. Since there is no living body in the room, so it is not necessary to display the audio-visual information on the display device arranged inside the door body, and it only needs to notify the user remotely about the fires. The user may determine the degree of danger based on the audio-visual information, and decide whether to report the fire or contact people near the fires.

In some exemplary embodiments of the disclosure, in situations A, C and E, in order to prevent the user from missing the information (for example, the user does not have the mobile phone with him) when sending the audio-visual information to the user, the alarm may also be controlled to alert the user.

In some exemplary embodiments of this disclosure, in each situation, when the door is opened automatically and the user is notified about the fire, the controller 130 may also issue a fire alarm, so as to avoid the case that the user does not check the information in time or the user does not report the fire in time.

According to the present disclosure, the intelligent door includes the sensors installed on the inner and outer sides of the intelligent door body to determine whether there is a fire, and then automatically open the door based on the fire situation for people to escape, or notifies the user about the fire.

In summary, after reading this detailed disclosure, those skilled in the art may understand that the foregoing detailed disclosure is only illustrative, and not restrictive. Although not explicitly stated herein, those skilled in the art will understand that this disclosure is intended to cover various changes, improvements and modifications to the embodiments. These changes, improvements and modifications are intended to be proposed by this disclosure and are within the scope of this disclosure.

What is claimed is:

1. An intelligent door control system, comprising:

a first sensor arranged on a door body of an intelligent door to sense an indoor parameter of ambient environment at an indoor side of the door body;

a second sensor arranged on an outdoor side of the intelligent door to sense an outdoor parameter of ambient environment at outdoor side of the door body;

a controller in communication with the first sensor and the second sensor to:

receive the indoor parameter and the outdoor parameter, compare the indoor parameter with a corresponding indoor parameter threshold to obtain a first result, compare the outdoor parameter with a corresponding outdoor parameter threshold to obtain a second result, compare the indoor parameter with the outdoor parameter to obtain a third result, and automatically control the intelligent door based on the first result, the second result, the third result, and whether there is a living body at the indoor side of the intelligent door.

2. The intelligent door control system according to claim 1, wherein, the controller is in a presence mode when there is a living body at the indoor side of the intelligent door; and the controller is in an absence mode when there is no living body inside the intelligent door.

3. The intelligent door control system according to claim 2, wherein, in the presence mode, the controller controls the door body to open automatically when the indoor parameter is higher than the indoor parameter threshold and the outdoor parameter is no higher than the outdoor parameter threshold.

4. The intelligent door control system according to claim 3, wherein, the controller further controls the door body to stay in an open state after being automatically opened.

5. The intelligent door control system according to claim 2, wherein, in the absence mode, the controller automatically sends an alarm to a client in communication with the intelligent door when the indoor parameter is higher than the indoor parameter threshold and the outdoor parameter is no higher than the outdoor parameter threshold.

6. The intelligent door control system according to claim 2, further comprising:

an audio-visual acquisition device installed in the door body to acquire audio-visual information from the outdoor side of the door body; and a display device installed in the door body to display the audio-visual information, wherein the audio-visual acquisition device and the display device are in communication with the controller, and automatically turned on upon receiving an automatic turn-on instruction from the controller.

7. The intelligent door control system according to claim 6, wherein when the controller is in the presence mode, the indoor parameter is not higher than the indoor parameter threshold, and the outdoor parameter is higher than the outdoor parameter threshold:

the audio-visual acquisition device is activated to acquire the audio-visual information from the outdoor side of the door body;

the display device displays the audio-visual information; and the controller sends the audio-visual information to a client in communication with the intelligent door.

8. The intelligent door control system according to claim 6, wherein when the controller is in the absence mode, the indoor parameter is not higher than the indoor parameter threshold, and the outdoor parameter is higher than the outdoor parameter threshold:

the audio-visual acquisition device is turned on to acquire the audio-visual information outside the door body; and the controller sends the audio-visual information to a client in communication with the intelligent door.

9. The intelligent door control system according to claim 6, wherein when the controller is in the presence mode, the indoor parameter is higher than the indoor parameter threshold, and the outdoor parameter is higher than the outdoor parameter threshold:

the audio-visual acquisition device is turned on to acquire the audio-visual information outside the door body;

the display device displays the audio-visual information; and the controller sends the audio-visual information to a client in communication with the intelligent door.

10. The intelligent door control system according to claim 6, wherein when the controller is in the absence mode, the indoor parameter is higher than the indoor parameter threshold, and the outdoor parameter is higher than the outdoor parameter threshold:

the audio-visual acquisition device is turned on to acquire the audio-visual information outside the door body; and the controller sends the audio-visual information to a client in communication with the intelligent door.

11. The intelligent door control system according to claim 2, further comprising an alarm device in communication with the controller installed on the door body, being automatically turned on upon receiving an automatic turn-on instruction from the controller, wherein, when the indoor parameter is higher than the indoor parameter threshold, or the outdoor parameter is higher than the outdoor parameter threshold:

the alarm device sends out an alarm when the controller is in the presence mode.

12. The intelligent door control system according to claim 1, wherein, the indoor parameter is at least one of an ambient temperature or a smoke concentration of the indoor side of the door body, and the indoor parameter threshold is at least one of a corresponding preset first temperature threshold or a corresponding preset first smoke concentration threshold, and the outdoor parameter is at least one of an ambient temperature or a smoke concentration of the outdoor side of the door body, and the outdoor parameter threshold is at least one of a corresponding preset second temperature threshold or a corresponding preset second smoke concentration threshold.

13. The intelligent door control system according to claim 12, wherein, the controller adjusts the first temperature threshold and the second temperature threshold based on location information and weather information.

14. An intelligent door control method, comprising:

receiving, by a controller, an indoor parameter of ambient environment at an indoor side of a door body from a first sensor and an outdoor parameter of ambient environment at an outdoor side of the door body from a second sensor;

comparing the indoor parameter with a corresponding indoor parameter threshold to obtain a first result;

comparing the outdoor parameter with a corresponding outdoor parameter threshold to obtain a second result;

comparing the indoor parameter with the outdoor parameter to obtain a third result; and controlling, by the controller, the intelligent door based on the first result, the second result, the third result, and whether there is a living body at the indoor side of the intelligent door.

15. The intelligent door control method according to claim 14, wherein the controlling of the intelligent door based on the first result, the second result, and whether there is a living body at the indoor side of the intelligent door includes:

controlling the door body to open when there is a living body at the indoor side of the intelligent door, the indoor parameter is higher than the indoor parameter threshold, and the outdoor parameter is not higher than the outdoor parameter threshold.

16. The intelligent door control method according to claim 15, further comprising:

keeping the door body to stay in an open state after the door body is controlled to open.

17. The intelligent door control method according to claim 14, wherein the controlling of the intelligent door based on the first result, the second result, and whether there is a living body at the indoor side of the intelligent door includes:

automatically sending, by the controller, an alarm to a client in communication with the intelligent door when there is no living body at the indoor side, the indoor parameter is higher than the indoor parameter threshold, and the outdoor parameter is not higher than the outdoor parameter threshold.

18. The intelligent door control method according to claim 14, wherein the controlling of the intelligent door based on the first result, the second result, and whether there is a living body at the indoor side of the intelligent door includes:

when there is a living body at the indoor side of the intelligent door, the indoor parameter is not higher than the indoor parameter threshold, and the outdoor parameter is higher than the outdoor parameter threshold:

turning on an audio-visual acquisition device to acquire audio-visual information from the outdoor side of the door body;

displaying the audio-visual information on a display device; and sending, by the controller, the audio-visual information to a client in communication with the intelligent door.

19. The intelligent door control method according to claim 14, wherein the controlling of the intelligent door based on the first result, the second result, and whether there is a living body at the indoor side of the intelligent door includes:

when there is no living body at the indoor side of the intelligent door, the indoor parameter is not higher than the indoor parameter threshold, and the outdoor parameter is higher than the outdoor parameter threshold:

turning on an audio-visual acquisition device to acquire audio-visual information from the outdoor side of the door body; and sending, by the controller, the audio-visual information to a client in communication with the intelligent door.

20. The intelligent door control method according to claim 14, wherein the controlling of the intelligent door based on the first result, the second result, and whether there is a living body at the indoor side of the intelligent door includes:

when there is a living body at the indoor side of the intelligent door, the indoor parameter is higher than the indoor parameter threshold, and the outdoor parameter is higher than the outdoor parameter threshold:

turning on an audio-visual acquisition device to acquire audio-visual information from the outdoor side of the door body;

displaying the audio-visual information on a display; and sending, by the controller, the audio-visual information to a client in communication with the intelligent door.

21. The intelligent door control method according to claim 14, wherein the controlling of the intelligent door based on the first result, the second result, and whether there is a living body at the indoor side of the intelligent door includes:

when there is no living body at the indoor side of the intelligent door, the indoor parameter is higher than the indoor parameter threshold, and the outdoor parameter is higher than the outdoor parameter threshold:

turning on an audio-visual acquisition device to acquire audio-visual information from the outdoor side of the door body; and sending, by the controller, the audio-visual information to a client in communication with the intelligent door.

22. The intelligent door control method according to claim 14, wherein the controlling of the intelligent door based on the first result, the second result, and whether there is a living body at the indoor side of the intelligent door includes:

when the indoor parameter is higher than the indoor parameter threshold, and the outdoor parameter is higher than the outdoor parameter threshold, sending out an alarm when there is a living body at the indoor side of the intelligent door.

23. The intelligent door control method according to claim 14, wherein the indoor parameter is at least one of an ambient temperature or a smoke concentration of the indoor side of the door body, and the indoor parameter threshold is at least one of a corresponding preset first temperature threshold or a corresponding preset first smoke concentration threshold, and the outdoor parameter is at least one of an ambient temperature or a smoke concentration of the outdoor side of the door body, and the outdoor parameter threshold is at least one of a corresponding preset second temperature threshold or a corresponding preset second smoke concentration threshold, and the method further comprising: adjusting, by the controller, the first temperature threshold and the second temperature threshold based on location information and weather information.

* * * * *